US010512302B2

(12) United States Patent
Derrick et al.

(10) Patent No.: US 10,512,302 B2
(45) **Date of Patent: *Dec. 24, 2019**

(54) REMOVABLE SHOE SOLE SYSTEM

(71) Applicant: Pure Fishing, Inc., Spirit Lake, IA (US)

(72) Inventors: Christopher Derrick, Ridgeway, SC (US); Joseph McMillan, Portland, OR (US); Peter Rueegger, Portland, OR (US); Michael Steszyn, Portland, OR (US); Peter Valois, Portland, OR (US)

(73) Assignee: Pure Fishing, Inc., Spirit Lake, IA (US)

( * ) Notice: Subject to any disclaimer, the term of this patent is extended or adjusted under 35 U.S.C. 154(b) by 176 days.

This patent is subject to a terminal disclaimer.

(21) Appl. No.: 15/673,845

(22) Filed: Aug. 10, 2017

(65) Prior Publication Data

US 2017/0332732 A1 Nov. 23, 2017

Related U.S. Application Data

(63) Continuation of application No. 14/714,679, filed on May 18, 2015, now Pat. No. 9,756,900.

(60) Provisional application No. 62/052,922, filed on Sep. 19, 2014.

(51) Int. Cl.
*A43B 3/24* (2006.01)
*A43B 13/36* (2006.01)

(52) U.S. Cl.
CPC ..... *A43B 13/36* (2013.01); *A43B 3/242* (2013.01); *A43B 3/244* (2013.01); *A43B 3/246* (2013.01)

(58) Field of Classification Search
CPC ..... A43B 21/36; A43B 3/24; A43B 3/26
USPC ..... 36/15, 103, 36 R, 100, 67 D
See application file for complete search history.

(56) References Cited

U.S. PATENT DOCUMENTS

| | | | |
|---|---|---|---|
| 1,631,710 | A | 6/1927 | Tranides et al. |
| 1,970,254 | A | 8/1934 | Sullivan et al. |
| 2,640,283 | A | 6/1953 | McCord et al. |
| 4,267,650 | A | 5/1981 | Bauer |
| 4,494,323 | A | 1/1985 | Latraverse |

(Continued)

FOREIGN PATENT DOCUMENTS

GB 575489 A 2/1946

OTHER PUBLICATIONS

"Proximate, adj" freedictionary.com. Web. Mar. 26, 2019.*

*Primary Examiner* — Sally Haden
*Assistant Examiner* — Jillian K Pierorazio
(74) *Attorney, Agent, or Firm* — Husch Blackwell LLP

(57) ABSTRACT

A shoe system including a shoe upper with a bottom side having an aperture extending to a cavity. The shoe system also includes a selectively removable outsole which includes a bottom for contacting the ground, and a top for engaging with the bottom of the shoe upper. The top side of the outsole further includes a projection which is sized and shaped to extend through the aperture and into the cavity when the outsole is in a first orientation, which is misaligned with respect to the shoe upper. The projection is also sized and shaped to fit within the cavity but no longer back through the aperture when the outsole is in a second orientation, which is aligned with respect to the shoe upper. In the second orientation, the projection within said cavity prevents disengagement of the outsole from the shoe upper.

16 Claims, 3 Drawing Sheets

(56) References Cited

U.S. PATENT DOCUMENTS 4,805,320 A * 2/1989 Goldenberg ..... A43B 1/0054 36/36 R
D378,548 S 3/1997 Harman
6,311,416 B1 * 11/2001 Cohen ..... A43B 7/00 36/115
6,467,198 B1 10/2002 James
6,481,121 B1 * 11/2002 Tucker ..... A43B 13/26 36/15
6,813,847 B2 11/2004 Workman
7,254,905 B2 * 8/2007 Dennison ..... A43B 7/18 36/15
7,331,123 B2 2/2008 Workman et al.
7,520,069 B2 4/2009 Workman et al.
7,984,569 B2 7/2011 Chaney et al.
8,074,376 B1 12/2011 Teteriatnikov
8,112,906 B2 * 2/2012 Paik ..... A43B 3/24 36/100
9,009,990 B2 4/2015 Angiulo et al.
2001/0052195 A1 * 12/2001 Blakey ..... A43B 3/24 36/100
2003/0200676 A1 * 10/2003 Gross ..... A43B 1/0081 36/15
2005/0039350 A1 * 2/2005 Hung ..... A43B 7/32 36/107
2006/0021260 A1 2/2006 Kim
2008/0060223 A1 * 3/2008 Keating ..... A43B 3/24 36/71.5
2008/0301978 A1 * 12/2008 Colella ..... A43B 3/24 36/101
2010/0088927 A1 * 4/2010 Spinelli ..... A43B 3/24 36/101
2013/0067770 A1 * 3/2013 Sherwood ..... A43B 21/39 36/100
2013/0312285 A1 11/2013 Sharma et al.
2015/0264994 A1 9/2015 Guardado

* cited by examiner

REMOVABLE SHOE SOLE SYSTEM

CROSS REFERENCE TO RELATED APPLICATION

This application is a continuation of U.S. patent application Ser. No. 14/714,679, which was filed on May 18, 2015, and which claims the benefit of U.S. Provisional Patent Application No. 62/052,922, filed on Sep. 19, 2014, titled "Removable Shoe Sole System." The entire disclosures of these applications are incorporated herein by reference.

BACKGROUND OF THE INVENTION

The present invention generally relates to a twist lock shoe sole system. More specifically, the present invention relates to a shoe sole system with interchangeable shoe soles which are selectively detachable from a shoe midsole via a twist lock mechanism.

Shoes having replaceable soles are well-known in the prior art. Several examples of such structures are disclosed in U.S. Pat. Nos. 7,520,069 and 6,813,847. The mechanism by which the replaceable soles attach to the shoe uppers vary. For example, shoes exist in the marketplace with sole cavities designed to receive one of various sole plates. The various sole plates include different tread patterns thereon. Further, many such shoes further include a strap on the rear side of the sole plate which is attachable to a portion of the shoe upper, at the heel of the shoe.

However, many products available on the market have problems with maintaining the engagement between the sole plate and the shoe upper in some conditions. For example, when walking through mud or other so-called "sloppy" terrain, the sole plate may be pulled from its engagement with the shoe upper. When lifting a foot from the mud, suction may act on the sole plate, thereby causing an unwanted release of the sole plate from the shoe upper.

Therefore, a better mechanism for selectively engaging the shoe sole with the shoe upper/midsole is needed.

SUMMARY OF THE PRESENT INVENTION

In one embodiment a shoe system comprises a shoe upper and an outsole. The shoe upper may include an upper, an insole, a midsole, and/or a portion of an outsole. The shoe upper may include a selectively depressible button proximate a heel portion of the shoe, as well as a bottom side with at least one slot and a recess. The recess preferably includes a cover which further includes an aperture. The aperture preferably defines an opening in the cover which leads into the recess.

The selectively removable outsole is preferably engageable with the shoe upper. An upper side of the outsole preferably includes at least one flange sized and shaped to engage the at least one slot in said shoe upper. The outsole preferably also includes a heel cup including a hole for accepting the depressible button when the button is not depressed. The outsole preferably also includes a key lock sized and shaped to extend through the aperture in the cover, and into the recess in the shoe upper. The key lock is preferably positioned on the outsole to fit through the aperture when said outsole is misaligned with said shoe upper, and upon positioning the key lock through the aperture and into the recess, the outsole and shoe upper may be rotated into alignment with one another. This rotation preferably causes the key lock to rotate within the recess such that the key lock does not fit back out through the aperture in the cover. Additionally, the rotation causes the at least one flange to slide into and engage with the at least one slot, and causes the heel cup to slide over the button such that the button fits within the hole of the heel cup.

In another embodiment, a shoe system comprises a shoe upper including a bottom side with an aperture extending to a cavity. The shoe system also comprises a selectively removable outsole which includes a bottom for contacting the ground, and a top for engaging with the bottom of said shoe upper. The top side of the outsole further includes a projection which is sized and shaped to extend through the aperture and into the cavity when the outsole is in a first orientation, which is misaligned with respect to the shoe upper. The projection is also sized and shaped to fit within the cavity but no longer back through the aperture when the outsole is in a second orientation, which is aligned with respect to the shoe upper. In the second orientation, the projection within said cavity prevents disengagement of the outsole from the shoe upper.

Figure 1:
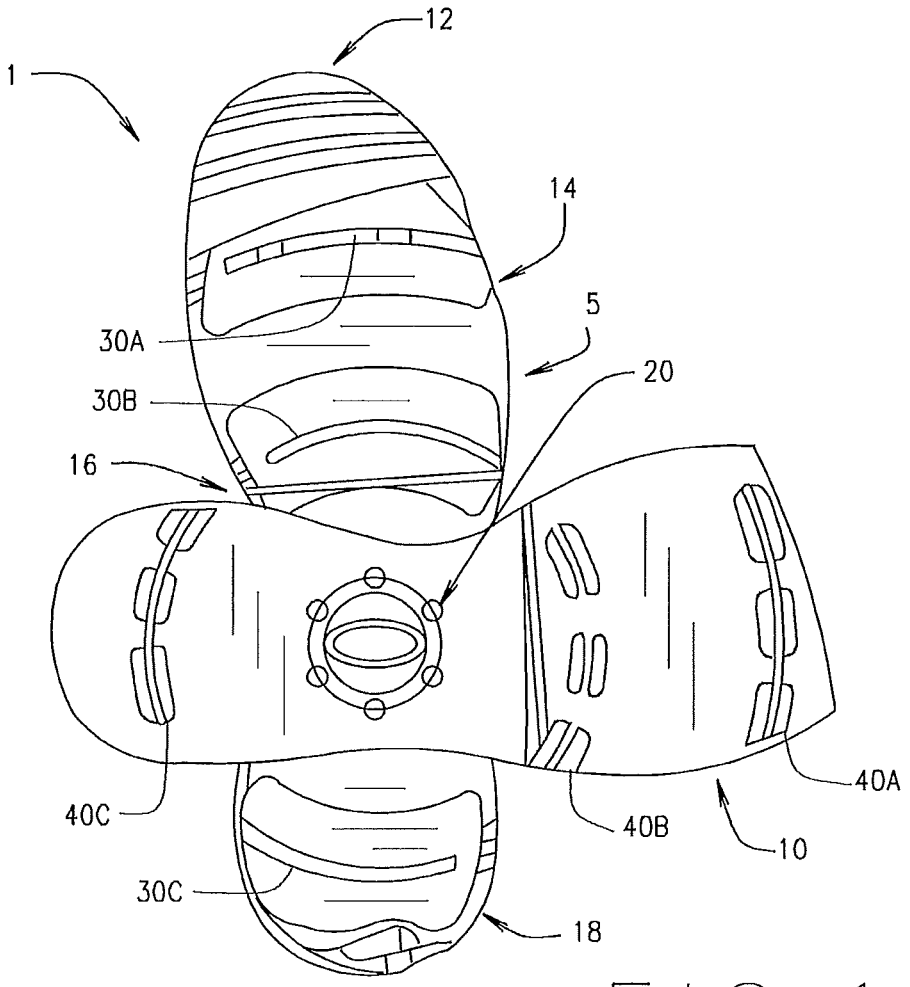
FIG. 1 illustrates a bottom plan view of a shoe system in a misaligned orientation according to an example embodiment of the present invention.

While the disclosure is susceptible to various modifications and alternative forms, specific embodiments thereof are shown by way of example in the drawings and will herein be described in detail. It should be understood, however, that the drawings and detailed description presented herein are not intended to limit the disclosure to the particular embodiment disclosed, but on the contrary, the intention is to cover all modifications, equivalents, and alternatives falling within the spirit and scope of the present disclosure as defined by the appended claims.

DETAILED DESCRIPTION OF THE DRAWINGS

FIG. 1 illustrates a bottom elevation view of a shoe system 1 in a misaligned orientation according to an embodiment of the present invention. As can be see, shoe system 1 includes a shoe upper 5 and a selectively removable outsole 10. It is noted that shoe upper 5 is shown as a midsole, rather than a traditional shoe upper. However, for the purposes hereof, shoe upper 5 is understood to be a term which may include a traditional shoe upper, an insole, a sock liner, a strobe, a midsole, and/or a portion of an outsole. As would be understood by a person of ordinary skill in the art, outsole 10 includes a bottom surface for contacting the ground. Further, a bottom side of shoe upper 5 is designed to engage with the top side of outsole 10, as discussed in detail below.

Other general footwear terms will now be discussed. Both upper 5 and outsole 10 may include general areas which will be discussed with respect to the portion of the human foot which would occupy these general areas. Specifically, toe portion 12 is located generally at the front of the shoe, while ball portion 14 is located generally proximate the toe portion 12, at about the location that the ball of the wearer's foot would be located. Arch portion 16 is positioned between the ball portion 14 and heel portion 18, which is located at the rear of the shoe. Toe, ball, arch, and heel portions 12-18 will each be understood by a person of ordinary skill in the art.

As shown in FIG. 1, shoe system 1 may include several elements for selectively engaging the outsole 10 with the shoe upper 5. For example, a twist-lock mechanism 20 may be located at approximately the arch portion 16 of each of the outsole 10 and upper 5. It is recognized that the actual location of the twist-lock mechanism 20 is not vital, and could be adjusted without departing from the spirit hereof. As best seen in FIGS. 2A, 2B, 3, and 4, twist lock mechanism 20 preferably includes a recess 22 in shoe upper 5. A cover 24 which extends over the recess 22 preferably includes an aperture 26 through the cover 24 extending to the recess 22. The outsole 10 preferably includes a projection 28, which may also be referred to herein as a key lock.

Figure 2A:
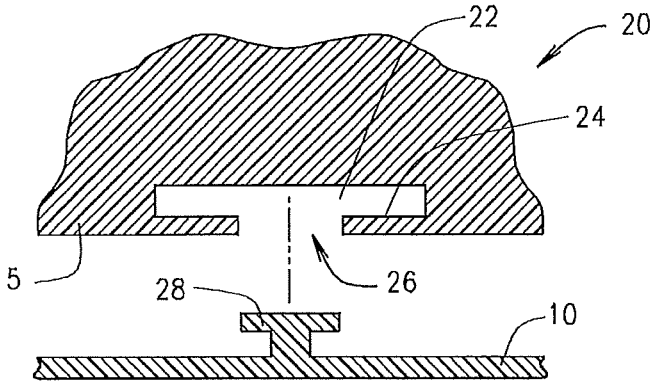
FIG. 2A illustrates a longitudinal exploded cross-sectional view of a twist-lock mechanism in the misaligned orientation according to an example embodiment of the present invention.
Figure 2B:
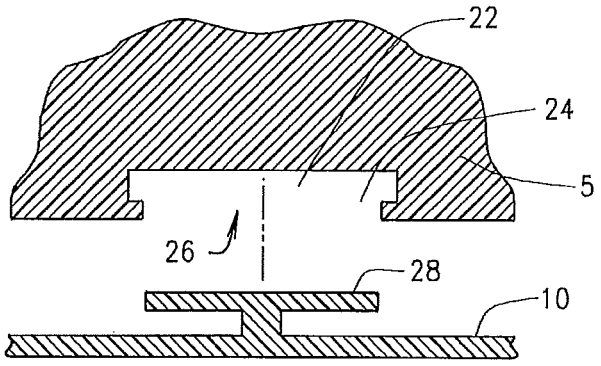
FIG. 2B illustrates a latitudinal exploded cross-sectional view of the twist lock mechanism of FIG. 2A.

As shown in FIG. 1, the misaligned orientation of the outsole 10 may be approximately perpendicular to the upper 5, although the exact offset degree could be modified. FIG. 2A illustrates a cross-sectional view of the twist-lock mechanism, viewed longitudinally to the upper 5, with the outsole 10 in its misaligned orientation. FIG. 2B illustrates a cross-sectional view of the twist-lock mechanism, viewed latitudinally to the upper 5, with the outsole still in its misaligned orientation. As can be seen, in the preferred embodiment illustrated in FIGS. 2A and 2B, the projection 28 and the aperture 26 may each be relatively elongate and narrow, such that the projection 28 is sized and shaped to extend through the aperture 26 in cover 24 when the outsole 10 is in its misaligned orientation with respect to the shoe upper 5.

Figure 3:
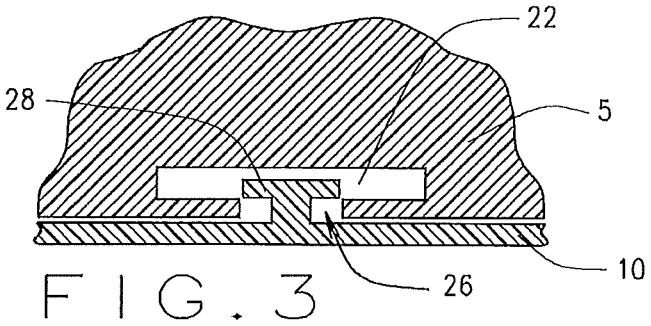
FIG. 3 illustrates a longitudinal cross-sectional view of the twist lock mechanism of FIGS. 2A and 2B in the misaligned orientation.

Thus, to engage the twist-lock mechanism 20, the projection 28 of outsole 10 is positioned within the recess 22 via aperture 26 in cover 24, as seen in FIG. 3. The outsole begins in the misaligned orientation for this to occur. Once the projection 28 is through the aperture 26 and is positioned within the cavity 22, the outsole 10 is rotated with respect to the shoe upper 5 into its aligned position. In the embodiments shown, this rotation preferably occurs about an axis of rotation through the center of the projection/aperture/recess 28/26/22. The aligned position of outsole 10 is preferably longitudinally aligned with the shoe upper 5. In its aligned orientation, the outsole 10 and shoe upper 5 effectively appear to be a completed shoe.

Figure 4:
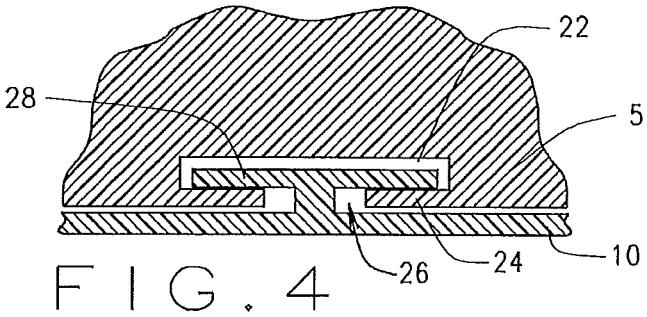
FIG. 4 illustrates a longitudinal cross-sectional view of the twist lock mechanism of FIGS. 2A, 2B, and 3 in an aligned orientation.

The positioning of the projection 28 within recess 22 in the aligned orientation is shown in FIG. 4. As can be seen, the projection 28 has rotated along with the outsole 10 with respect to the shoe upper 5. In the aligned orientation, the projection 28 no longer fits back out through the aperture 26 in cover 24. Although the outsole 10 and upper 5 are aligned, the elongate projection 28 is no longer aligned with the elongate aperture 26, and is therefore selectively locked therein. To release the twist-lock mechanism 20 once engaged, the outsole 10 would simply be rotated back into the misaligned orientation, thereby allowing the projection 28 to fit out through the aperture 26 again.

It is recognized that other shapes of projections/key locks 28 and apertures 26 would be acceptable. Effectively, any shape of projection 28 and aperture 26 would suffice so long as the projection 28 can fit through the aperture 26 when the outsole 10 is in its misaligned orientation, and so long as rotation of the outsole 10 into the aligned position serves to misalign the projection 28 and aperture 26 to prevent removal of the projection 28 through the aperture 26. The size and shape of recess 24 should therefore also be able to accommodate rotation of the projection 28 therewithin. Additionally, other axes of rotation could be implemented, with resulting structural modifications as would be appropriate and understood.

Other structures may also be used to releasably secure outsole 10 to upper 5. For example, FIG. 1 illustrates slots 30 in the bottom of shoe upper 5: two forward slots 30A, 30B proximate the ball portion 14 of upper 5, and a rear slot 30C proximate the heel portion 18 of upper 5. Slots 30 are structured to accept and retain flanges 40 therewithin. As shown in FIG. 1, there are three flanges 40 which correspond to the three slots 30: two forward flanges 40A, 40B proximate the ball portion 14 of outsole 10, and a rear flange 40C proximate the heel portion 18 of outsole 10. Of course, more or fewer slot/flange (30/40) pairings may be included, as desired, and the locations of these slot/flange (30/40) pairings may be altered as desired.

Figure 5:
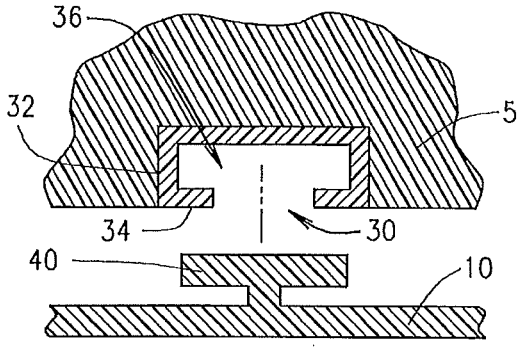
FIG. 5 illustrates an exploded longitudinal cross-sectional view of a slot and flange according to an example embodiment of the present invention.

One exemplary structure of a slot 30 and flange 40 is shown in FIG. 5. In the illustrated embodiment, slot 30 is formed by an insert 34 positioned within a cutout 32. Insert 34 is sized and shaped to include a hollow 36 which is shaped to receive a flange 40. Insert 34 may be glued into cutout 32, or upper 5 may be molded around existing inserts 34. Additionally, it will be recognized that slot 30 may be formed without an insert 34, such that hollow 36 is molded directly into the bottom of shoe upper 5. Other acceptable structures will also be recognized. As a non-limiting example, each insert 34 for each of slots 30A, 30B, and 30C may be formed in a single unitary component which is attached to the bottom of shoe upper 5. Similarly, recess 22, cover 24, and aperture 26 may be formed out of the same unitary component as the inserts 34.

As shown in FIG. 5, flange 40 is generally T-shaped. Therefore, insert 34 is shown as including a generally T-shaped hollow to accept the flange 40 therewithin. However, other shapes of flanges 40 and hollows 36 are envisioned, such as L-shapes or other shapes as would be understood by a person of ordinary skill in the art. Hollow 36 may be somewhat larger than flange 40 to allow for some amount of play therebetween. Of course, insert 34 should retain flange 40 therein when flange 40 slides into hollow 36, but a small amount of play may allow for proper performance even when dirt or other materials find their way into hollow 36.

As is also shown in FIG. 1, slots 30 and flanges 40 may be curved or radiused. Preferably, each of said slots 30 and flanges 40 is radiused about the axis of rotation of the outsole 10 with respect to the upper 5. Such radiusing allows the flanges 40 to slide into their respective slots 30 when the outsole 10 is rotated from its misaligned into its aligned orientation. In the aligned orientation, slots 30 fully receive their respective flanges 40 therein, so as to further secure the outsole 10 to the shoe upper 5.

Figure 6:
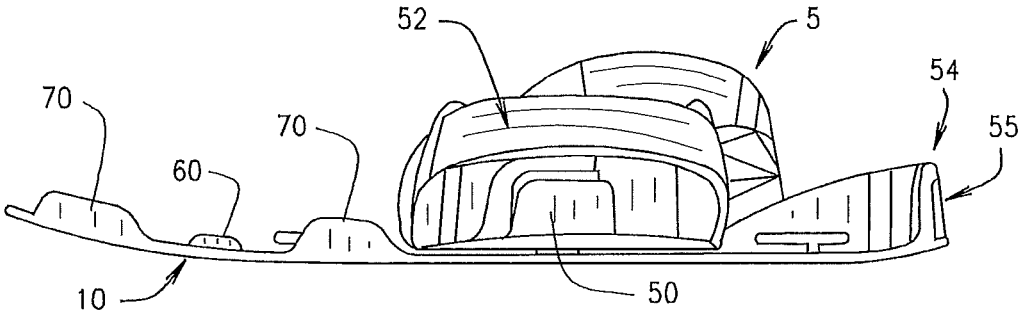
FIG. 6 illustrates a side elevation view of the shoe system of FIG. 1, in the misaligned orientation.

FIG. 6 illustrates two optional structures for securing the outsole 10 with the shoe upper 5 in the aligned orientation. As can be seen, shoe upper 5 may include a selectively depressible button 50 at its heel cup 52. Outsole 10 may have its own heel cup 54 which extends upwardly from the heel portion 18 of outsole 10. The heel cup 54 of outsole 10 preferably includes a hole 55 sized and shaped to accept the button 50 therein. Rotation of the outsole 10 from the misaligned position into the aligned position causes the heel cup 54 of outsole 10 to rotate over and around heel cup 52 of shoe upper 5. As the heel cup 54 of outsole 10 passes over the upper's heel cup 52 and its button 50, the button 50 depresses. Once the outsole 10 reaches its aligned orientation, the button 50 preferably aligns with hole 55, such that button 50 is no longer forced into its depressed position. The button 50 therefore pops out into its resting position, where it extends through and engages with hole 55, securing the outsole 10 in its aligned orientation with respect to upper 5. To release outsole 10 from upper 5, a user may depress button 50 to disengage it from hole 55. The outsole 10 may then be rotated back to its misaligned orientation for removal.

Figure 7:
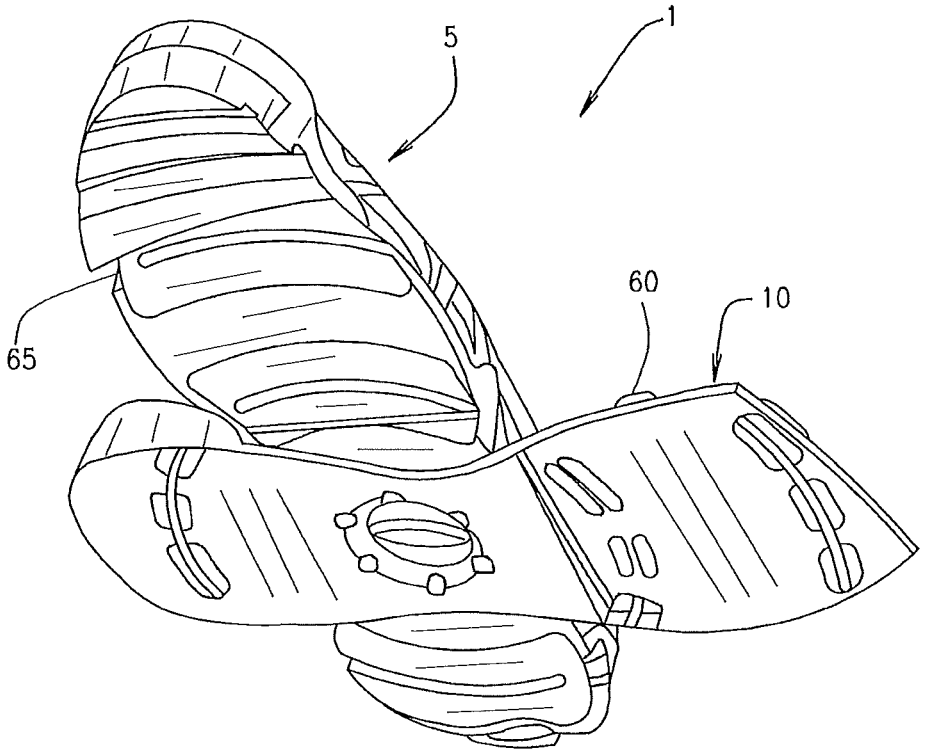
FIG. 7 illustrates a perspective view of the shoe system of FIG. 1, in the misaligned orientation.

FIG. 6 also illustrates another optional mechanism for securing the outsole 10 in its aligned orientation with respect to upper 5. A tab 60 is visible on one side of the outsole 10, and a notch 65 is visible in FIG. 7 on a corresponding side of upper 5. Rotation of the outsole 10 from the misaligned position into the aligned position causes the tab 60 to pass under the bottom of shoe upper 5. Thus, the outsole 10 is forced to deflect somewhat in order to allow the tab 60 to pass under the bottom of upper 5. Once the outsole 10 reaches its aligned orientation, the tab 60 mates with notch 65, allowing the outsole to rebound back to its normal shape. Tab 60 in notch 65 therefore helps to secure the outsole 10 in its aligned orientation with respect to upper 5. To release outsole 10 from upper 5, a user may physically pull tab 60 out of notch 65 to disengage the two, and outsole 10 may then be rotated back to its misaligned orientation for removal.

Additional structures which may be employed are plates 70 extending up from one side of outsole 10. Plates 70 may simply abut a side of shoe upper 5 when the outsole 10 is in the aligned position, so as to help prevent over-rotation of the outsole 10 past its aligned position.

It is also recognized that a selectively engagable outsole 10 may form the entirety of the ground-contacting surface of the assembled shoe system 1. However, as shown herein, at the toe portion 12 of shoe upper 5, a portion of non-releasable outsole is shown. Thus, in the embodiments illustrated, an interchangeable outsole 10 from the heel portion 18 to about the ball portion 14. This is merely one option, and should not be considered limiting.

Alternatively, it is recognized that the position of the key lock 28 and the aperture/cover/recess 26/24/22 could be reversed, such that the key lock 28 is positioned on the shoe upper 5 and the aperture/cover/recess 26/24/22 are positioned on the outsole 10. The same is true of the flange/slot 40/30, and tab/notch 60/65.

Thus, there has been shown and described several embodiments of a novel shoe system. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present invention will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

The invention claimed is:

1. A shoe system comprising:

a shoe upper including a bottom side, said shoe upper including:

at least one elongated slot on the bottom side, the at least one elongated slot being at least two elongated slots, with at least one proximate a heel portion of the shoe upper and at least another proximate a ball portion of the shoe upper;

a depressible button; and a recess on the bottom side, said recess including a cover, said cover further including an aperture, said aperture defining a smooth opening in the cover leading into the recess;

a removable outsole re-engageable with the shoe upper, an upper side of said removable outsole including:

at least one elongated flange sized and shaped to engage the at least one elongated slot in said shoe upper;

a heel cup including a hole, said hole for accepting the depressible button when said depressible button is not depressed;

a key lock sized and shaped to extend through the aperture in the cover, into the recess in the shoe upper;

wherein said key lock is positioned on said removable outsole to fit through the aperture when said removable outsole is misaligned with said shoe upper;

wherein upon positioning the key lock through the aperture and into the recess, and rotating the removable outsole into alignment with the shoe upper, said rotation of the removable outsole causes:

said key lock to rotate within the recess such that the key lock does not fit back out through the aperture in the cover;

said at least one elongated flange to slide into and engage with the at least one elongated slot; and said heel cup to slide over the depressible button such that the depressible button fits within the hole of the heel cup.

2. The shoe system of claim 1 wherein at least one of the at least one elongated slot has a generally T-shaped cross section.

3. The shoe system of claim 1 wherein each of said at least one elongated slot is radiused about a center point of rotation of the removable outsole with respect to the shoe upper.

4. The shoe system of claim 1 wherein said aperture and said key lock are elongate.

5. The shoe system of claim 1 wherein said recess and key lock are located proximate an arch portion of the shoe upper and removable outsole, respectively.

6. The shoe system of claim 1 wherein said aperture and a projection are elongate.

7. A shoe system comprising:

a shoe upper including a bottom side, said shoe upper including:

at least one elongated slot on the bottom side;

a depressible button; and a recess on the bottom side, said recess including a cover, said cover further including an aperture, said aperture defining a smooth opening in the cover leading into the recess;

a removable outsole re-engageable with the shoe upper, an upper side of said removable outsole including:

at least one elongated flange sized and shaped to engage the at least one elongated slot in said shoe upper;

a heel cup including a hole, said hole for accepting the depressible button when said depressible button is not depressed;

a key lock sized and shaped to extend through the aperture in the cover, into the recess in the shoe upper;

wherein said key lock is positioned on said removable outsole to fit through the aperture when said removable outsole is misaligned with said shoe upper;

wherein upon positioning the key lock through the aperture and into the recess, and rotating the removable outsole into alignment with the shoe upper, said rotation of the removable outsole causes:

said key lock to rotate within the recess such that the key lock does not fit back out through the aperture in the cover;

said at least one elongated flange to slide into and engage with the at least one elongated slot; and said heel cup to slide over the depressible button such that the depressible button fits within the hole of the heel cup;

a tab extending from one side of said removable outsole, said tab extending upwardly toward said shoe upper; and a notch in one side of said shoe upper for accepting the tab when said removable outsole and said shoe upper are engaged with one another and aligned.

8. A shoe system comprising:

a shoe upper including a bottom side, said bottom side including an aperture extending to a cavity and at least one elongate slot;

a removable and re-engageable outsole including a bottom for contacting the ground, and a top for engaging with the bottom side of said shoe upper, the top of said removable and re-engageable outsole further including a projection;

at least one elongate flange extending from the removable and re-engageable outsole, said at least one elongate flange being receivable within a respective one of said at least one elongate slot such that said at least one elongate flange slideably dovetails with said at least one elongate slot to further secure the removable and re-engageable outsole to the shoe upper;

wherein each of said at least one elongate slot and the corresponding at least one elongate flange are radiused about a center point of rotation of the removable and re-engageable outsole with respect to the shoe upper;

wherein said projection is sized and shaped to extend through said aperture into said cavity when said removable and re-engageable outsole is in a first orientation with respect to said shoe upper;

wherein said projection is sized and shaped to fit within said cavity but no longer through said aperture when said removable and re-engageable outsole is in a second orientation with respect to said shoe upper;

wherein in said second orientation, the projection within said cavity prevents disengagement of said removable and re-engageable outsole from said shoe upper; and wherein said second orientation of said removable and re-engageable outsole is in general alignment with said shoe upper;

a tab extending from one side of said removable and re-engageable outsole, said tab extending upwardly toward said shoe upper; and a notch in one side of said shoe upper for accepting the tab when said removable and re-engageable outsole is in said second orientation with respect to the shoe upper.

9. The shoe system of claim 8 further including:

a selectively depressible button positioned at a heel portion of said shoe upper;

a heel cup extending up from the top of the removable and re-engageable outsole, said heel cup including a hole for accepting the depressible button when said removable and re-engageable outsole is in said second orientation.

10. The shoe system of claim 8 wherein each of the at least one elongate slot has a generally T-shaped cross section.

11. The shoe system of claim 8 wherein the at least one elongate slot being at least two elongate slots, with at least one proximate a heel portion of the shoe upper and at least another proximate a ball portion of the shoe upper.

12. A shoe system comprising:

a shoe upper including a bottom side, said bottom side including an aperture extending to a cavity and at least two elongate slots, with at least one proximate a heel portion of the shoe upper and at least another proximate a ball portion of the shoe upper;

a removable and re-engageable outsole including a bottom for contacting the ground, and a top for engaging with the bottom side of said shoe upper, the top of said removable and re-engageable outsole further including a projection;

at least one elongate flange extending from the removable and re-engageable outsole, said at least one elongate flange being receivable within a respective one of said at least two elongate slots such that said at least one elongate flange slideably dovetails with said at least one elongate slot to further secure the removable and re-engageable outsole to the shoe upper;

wherein each of said at least one elongate slot and the corresponding at least one elongate flange are radiused about a center point of rotation of the removable and re-engageable outsole with respect to the shoe upper;

wherein said projection is sized and shaped to extend through said aperture into said cavity when said removable and re-engageable outsole is in a first orientation with respect to said shoe upper;

wherein said projection is sized and shaped to fit within said cavity but no longer through said aperture when said removable and re-engageable outsole is in a second orientation with respect to said shoe upper;

wherein in said second orientation; said projection within said cavity prevents disengagement of said removable and re-engageable outsole from said shoe upper; and wherein said second orientation of said removable outsole is in general alignment with said shoe upper.

13. The shoe system of claim 12 further including:

a tab extending from one side of said removable and re-engageable, said tab extending upwardly toward said shoe upper; and a notch in one side of said shoe upper for accepting the tab when said removable and re-engageable is in said second orientation with respect to the shoe upper.

14. The shoe system of claim 12 further including:

a selectively depressible button positioned at a heel portion of said shoe upper;

a heel cup extending up from the top of the removable and re-engageable outsole, said heel cup including a hole for accepting the depressible button when said removable and re-engageable outsole is in said second orientation.

15. The shoe system of claim 12 wherein each of the at least two elongate slot has a generally T-shaped cross section.

16. The shoe system of claim 12 wherein said aperture and said projection are elongate.

* * * * *